US005954545A

United States Patent [19]

Lehner

[11] Patent Number: 5,954,545

[45] Date of Patent: Sep. 21, 1999

[54] ELECTRICAL CONTACT

[75] Inventor: Antonio Lehner, Wiesbaden, Germany

[73] Assignee: The Whitaker Corporation, Wilmington, Del.

[21] Appl. No.: 08/933,497

[22] Filed: Sep. 18, 1997

[30] Foreign Application Priority Data

Sep. 30, 1996 [DE] Germany ..... 961 15 666

[51] Int. Cl.[6] ..... H01R 13/434

[52] U.S. Cl. ..... 439/746

[58] Field of Search ..... 439/745–749

[56] References Cited

U.S. PATENT DOCUMENTS

| | | | |
|---|---|---|---|
| 2,624,774 | 1/1953 | Cunningham | 439/745 |
| 3,581,271 | 5/1971 | Knitter | 439/746 |
| 3,808,589 | 4/1974 | Bonhomme | 439/747 |
| 5,266,056 | 11/1993 | Baderschneider et al. | 439/745 |
| 5,342,221 | 8/1994 | Peterson | 439/677 |
| 5,711,687 | 1/1998 | Kuiper-Moore et al. | 439/745 |
| 5,741,162 | 4/1998 | Kourimsky et al. | 439/746 |

FOREIGN PATENT DOCUMENTS

| | | | |
|---|---|---|---|
| 0 700 124-A2 | 3/1996 | European Pat. Off. | H01R 13/428 |

*Primary Examiner*—Hien Vu

*Attorney, Agent, or Firm*—Mary K. VanAtten; Driscoll A. Nina

[57] ABSTRACT

An electrical contact for an electrical connector assembly having a detached is specified latching tongue for latching in a chamber, the latching tongue originating from a base of the contact, a supporting tongue being provided on it, in order to provide additional kinking protection for the latching tongue, the free end of the supporting tongue resting on the base and running against a stop.

5 Claims, 1 Drawing Sheet

ELECTRICAL CONTACT

BACKGROUND OF THE INVENTION

1. Field of the Invention

An electrical contact for an electrical connector assembly for fitting into a chamber of a connector housing having a detached latching tongue for latching in a chamber, the latching tongue originating from a base of the contact.

2. Description of the Prior Art

In the car industry, stringent requirements are placed on the electrical connector assemblies with respect to secure retention of contacts in the associated connector housings. For this reason, so-called latching tongues or locking lances are provided on most contacts, for latching behind the housing parts. For example, an electrical contact with a latching tongue is known from EP 700 124 A2. The contact has a base from which the latching tongue is cut out. The latching tongue is also detached or bent away from the base, in order to achieve latching in the housing in this way. If a cable which is connected to an electrical contact is pulled, then the latching tongue applies at least a portion of the retaining forces. The latching tongue can be kinked outwards if the tensile forces are high.

SUMMARY OF THE INVENTION

The object of the present invention is to specify an electrical contact having a latching tongue which is protected against kinking.

The object is achieved by an electrical contact for an electrical connector arrangement for fitting into a chamber of a connector housing, having a detached latching tongue for latching in a chamber, which originates from a base of the contact, a supporting tongue being provided on the latching tongue, which supporting tongue extends in the opposite direction to the latching tongue, a stop being provided on the base, against which the supporting tongue strikes.

The arrangement according to the invention results in it being harder for the latching tongue to kink because of the additional supporting tongue. Such an arrangement can be provided for any latching tongue, that is to say for example on round or polygonal contacts with or without external springs. At least one supporting tongue is provided to support the latching tongue. This supporting tongue can be cut out of the latching tongue itself and extend in the opposite direction to the latching tongue, that is to say the free end of the supporting tongue is on the side on which the latching tongue has its fixed end, and vice versa. The free end of the latching tongue runs against a stop in such a manner that the latching tongue is additionally stiffened by the supporting tongue striking against the stop when the latching tongue is bent further away from the housing.

When a contact is fitted in a connector housing, then, at least initially for fitting into the chamber, the latching tongue is deflected towards the base of the contact and then, when the contact is in its final position, is disposed away from the base of the contact again because of the restoring resilient forces which exist. In order to avoid the cut-out supporting tongue being reintroduced into the opening from which the supporting tongue has been stamped during this process and becoming stuck there, it is particularly advantageous to provide a deformation of the base or of the latching spring tongue with the aid of stamped-out regions at the sides of the supporting tongue, so that the material extends under the supporting tongue and said supporting tongue can no longer be introduced into the cut-out region from which it was cut out.

It may likewise prove to be advantageous to stamp the supporting tongue in places in such a manner that it is broadened, that is to say it can no longer be re-introduced into the cut-out from which it was cut out, and is also lengthened, which means that its free end is always resting on the base. The stop should advantageously be provided such that the supporting tongue runs against this stop. However, it is not necessary for the supporting tongue to be in contact with the stop in the unloaded state itself. The specified improvement of a latching tongue allows the forces for pulling a contact out to be considerably increased.

DETAILED DESCRIPTION OF THE PREFERRED EMBODIMENT

Figure 1:
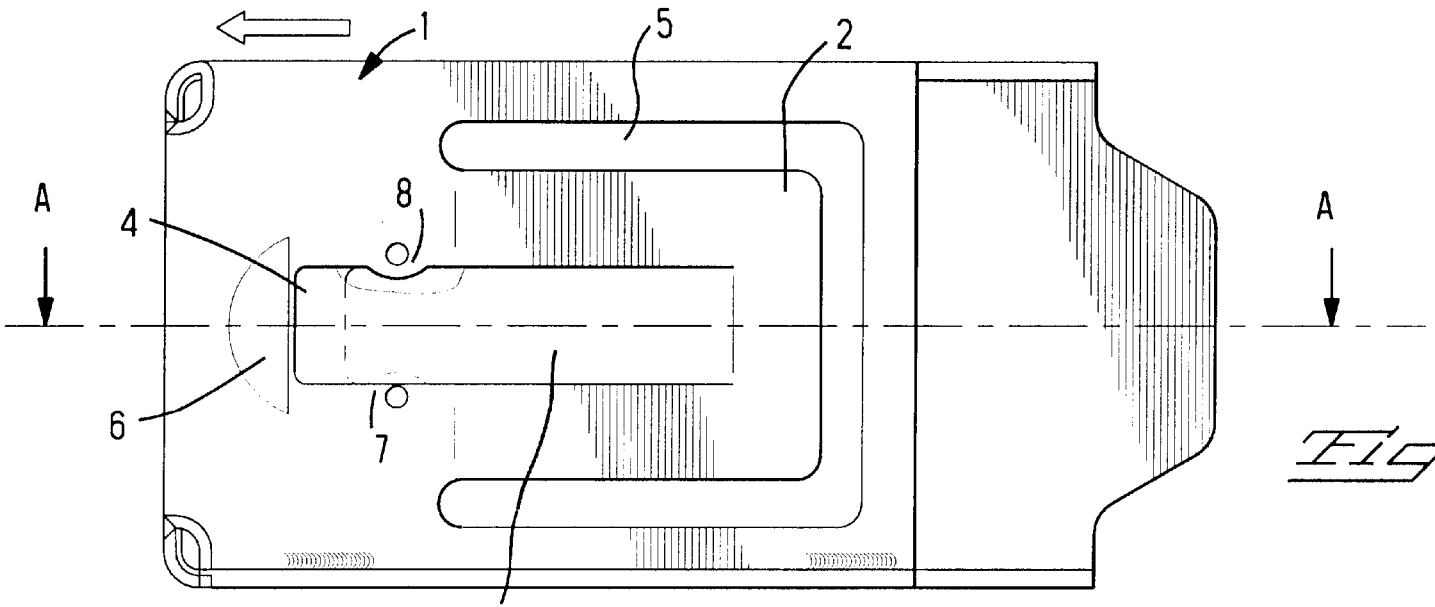
FIG. 1 shows a view of an external spring of a contact with a latching spring tongue according to the invention.

FIG. 1 shows an external spring of a contact which has a latching spring tongue 2. The latching spring tongue 2 is located in a side part, illustrated here as a base 1. The direction in which the contact is inserted into a housing chamber is illustrated by an arrow in FIG. 1. The latching spring tongue 2 is arranged in such a cantilever manner that is connected to the base 1 at the front (relative the insertion direction) and has its free end at the rear (relative the insertion direction).

In the opposite direction to this arrangement, a supporting tongue 3 is stamped-out of the latching spring tongue 2 leaving an opening 12. This supporting tongue 3 remains firmly connected to the latching spring tongue 2 close to the free end of the latching spring tongue 2 and the supporting tongue 3 has a free end 4 close to the front region of the contact in the insertion direction (Arrow A, FIG. 1). Located in front of the free end 4 (relative the insertion direction) is a stop 6 formed as half cup which is partially detached from the contact and is used as to stop the free end 4 of the supporting tongue 3. This stop 6 is designed in such a manner that upon outward deflection of the latching spring tongue 2, the supporting tongue 3 strikes the stop 6. The interaction of the stop 6 and the supporting tongue 3 protects the latching spring tongue 2 from kinking.

Figure 2:
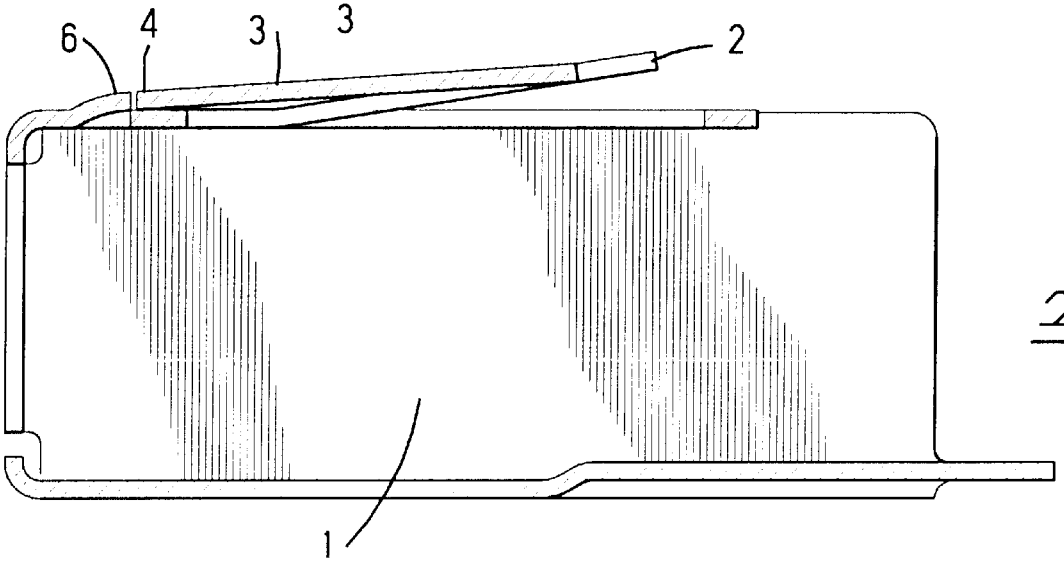
FIG. 2 shows a section along the section line 2—2 through the external spring illustrated in FIG. 1.

FIG. 2 shows that the latching spring tongue 2, a part 11 of the base 1 and the supporting tongue 3 form a triangle. In order that the supporting tongue 3 does not go back into the opening 12 from which it was cut out during manufacturing operations when the contact is being inserted into a contact chamber (not shown), it is possible, for example, to provide a stamped region along the supporting tongue 3 in such a manner that the supporting tongue 3 is broadened or lengthened; Alternatively, corresponding stamped regions 7, 8 for deformation along the sides in the base 1 to the left and right of the supporting tongue 3, in order that the deformed material extends behind said supporting tongue 3, so that the supporting tongue 3 cannot move back into the opening 12. Since the supporting tongue 3 can move freely as far as the stop 6, it is possible, because of the restoring forces of the latching tongue 2, for said latching tongue 2 to bend back towards the base 1 and to be reset. Apart from being provided as part of an external spring of a contact, the latching tongue can, of course, also be provided directly on the walls of an one-piece contact, and the exemplary embodiment illustrated here should thus not be regarded as a limitation.

A further option for increasing the pulling-out forces is for the free end of the latching tongue 2 to have a leading and a trailing tongue region. The leading tongue region may be sharpened while the trailing tongue region is blunt. Such a latching tongue may likewise also have a supporting tongue 3. It is intended in this case that the leading, sharpened tongue region cuts into the shoulder of the corresponding housing and that the trailing tongue region makes contact flat with a shoulder on the housing. This also increases the resistance to pulling-out forces.

I claim:

1. An electrical contact for fitting into a chamber of a connector housing, the electrical contact comprising a base and at least one latching tongue for latching the contact in the chamber, the latching tongue being cut out from the base of the contact and extending in a first direction outward from the base, a supporting tongue having a free end is provided on the latching tongue and extends in a second direction, opposite the first direction of the latching tongue, the supporting tongue being partially cut out of the latching tongue, and a stop is provided on the base in such a manner that the supporting tongue strikes against the stop with the free end when the latching tongue is deflected further away from the base.

2. The electrical contact according to claim 1, wherein the free end of the supporting tongue rests on the base.

3. The electrical contact according to claim 1, wherein the supporting tongue being cut out of the latching tongue defines an opening in the contact and a stamped region is provided as part of the contact such that the supporting tongue is prevented from being reintroduced into the opening.

4. The electrical contact according to claim 3, wherein the stamped region is formed along the opening.

5. The electrical contact according to claim 4, wherein a pair of stamped regions are formed along the opening opposite to one another.

* * * * *